US008356364B2

(12) United States Patent
Sides

(10) Patent No.: US 8,356,364 B2
(45) **Date of Patent: *Jan. 22, 2013**

(54) HUNTING GARMENT HAVING AN INFLATABLE SEAT

(76) Inventor: Mark Sides, St. Louis, MO (US)

( * ) Notice: Subject to any disclaimer, the term of this patent is extended or adjusted under 35 U.S.C. 154(b) by 291 days.

This patent is subject to a terminal disclaimer.

(21) Appl. No.: 12/707,036

(22) Filed: Feb. 17, 2010

(65) Prior Publication Data

US 2010/0154095 A1 Jun. 24, 2010

Related U.S. Application Data

(63) Continuation of application No. 11/390,633, filed on Mar. 28, 2006, now Pat. No. 7,707,650.

(51) Int. Cl.
*A41D 13/00* (2006.01)

(52) U.S. Cl. ..... 2/69

(58) Field of Classification Search ..... 2/455, 456, 2/465, 467, DIG. 3, 44, 46, 48, 115, 50, 51, 2/69, 88, 69.5, 227, 79, 85, 102, 108; 297/4, 297/DIG. 3, 180.11, 284.5
See application file for complete search history.

(56) References Cited

U.S. PATENT DOCUMENTS

| | | | | |
|---|---|---|---|---|
| 1,468,072 | A | 9/1923 | Ogle | |
| 1,626,166 | A | 4/1927 | Stair | |
| 2,661,474 | A | 12/1953 | Tate | |
| 2,736,030 | A | 2/1956 | Moody | |
| 3,185,362 | A | 5/1965 | Wakefield | |
| 3,665,517 | A | 5/1972 | Hyman | |
| 4,370,755 | A | 2/1983 | Crumby | |
| D270,585 | S | 9/1983 | Viio | |
| 4,674,479 | A | 6/1987 | Jennings et al. | |
| 4,718,375 | A | 1/1988 | Kreiger | |
| 4,737,994 | A | 4/1988 | Galton | |
| 4,894,869 | A | 1/1990 | Boll | |
| 5,086,514 | A | 2/1992 | Ross | |
| 5,271,659 | A | 12/1993 | Zinkevicz | |
| 5,303,425 | A | 4/1994 | Mele | |
| 5,588,699 | A | 12/1996 | Rundle et al. | |
| 5,727,260 | A | 3/1998 | Torch et al. | |
| 6,345,744 | B1 | 2/2002 | Eldridge | |
| 6,360,371 | B1 | 3/2002 | Davey | |
| 6,547,110 | B2 | 4/2003 | O'Hare | |
| 6,564,387 | B1 | 5/2003 | Willoughby | |
| 6,772,925 | B2 | 8/2004 | O'Hare | |
| 7,707,650 | B2 * | 5/2010 | Sides | 2/69 |
| 2003/0176825 | A1 | 9/2003 | Yavnai | |

* cited by examiner

*Primary Examiner* — Tejash Patel
(74) *Attorney, Agent, or Firm* — Armstrong Teasdale LLP

(57) ABSTRACT

A hunting garment includes an article of clothing, a pouch, an inflatable cushion, and an inflation device. The article of clothing has an interior surface and an exterior surface. The pouch includes an attachment member configured to couple the pouch to at least one of the interior surface and the exterior surface. The inflatable cushion is configured to be at least partially retained within the pouch when the inflatable cushion is in an inflated configuration. The inflation device is configured to inflate the inflatable cushion.

14 Claims, 3 Drawing Sheets

HUNTING GARMENT HAVING AN INFLATABLE SEAT

CROSS REFERENCE TO RELATED APPLICATIONS

This application is a continuation of U.S. patent application Ser. No. 11/390,633, filed Mar. 28, 2006, now U.S. Pat. No. 7,707,650 which is hereby incorporated by reference in its entirety.

BACKGROUND OF THE INVENTION

This invention relates generally to hunting garments, and more particularly, to a hunting garment having an inflatable cushion attached thereto.

Hunting vests are used by hunters in the United States and elsewhere. However, few of these vests address the comfort needs of the hunter. While hunting, the hunter may spend long periods of time seated in one place. Due to possible observation of movement of the hunter by the prey, a hunter attempts to remain still and move as little as possible. This often becomes uncomfortable for the hunter, and moreover, the hunter often becomes wet and cold due to moisture on the ground.

To facilitate maintaining hunter comfort, some vests have been designed such that a foam rubber cushion flips down from the bottom of the vest. However, this foam rubber cushion often provides little comfort and is not adjustable. Other seating devices include collapsible stools which are hand carried and then set up at a desired location, but these stools require the hunter to carry extra equipment.

BRIEF DESCRIPTION OF THE INVENTION

In one aspect, a hunting garment is provided that comprises an article of clothing. The hunting garment includes an inflatable cushion and a pouch attached to the article of clothing and configured to retain at least a portion of the cushion therein. The hunting garment further includes an inflation device connected to the cushion and configured to inflate and deflate the cushion.

In another aspect, a cushion system for a hunting garment is provided. The cushion system includes an inflatable cushion and an inflation device configured to inflate or deflate the cushion. The cushion system also includes a pouch configured to receive and retain at least a portion of the cushion therein. An attachment device is configured to attach the pouch to the hunting garment.

DETAILED DESCRIPTION OF THE INVENTION

Figure 1:
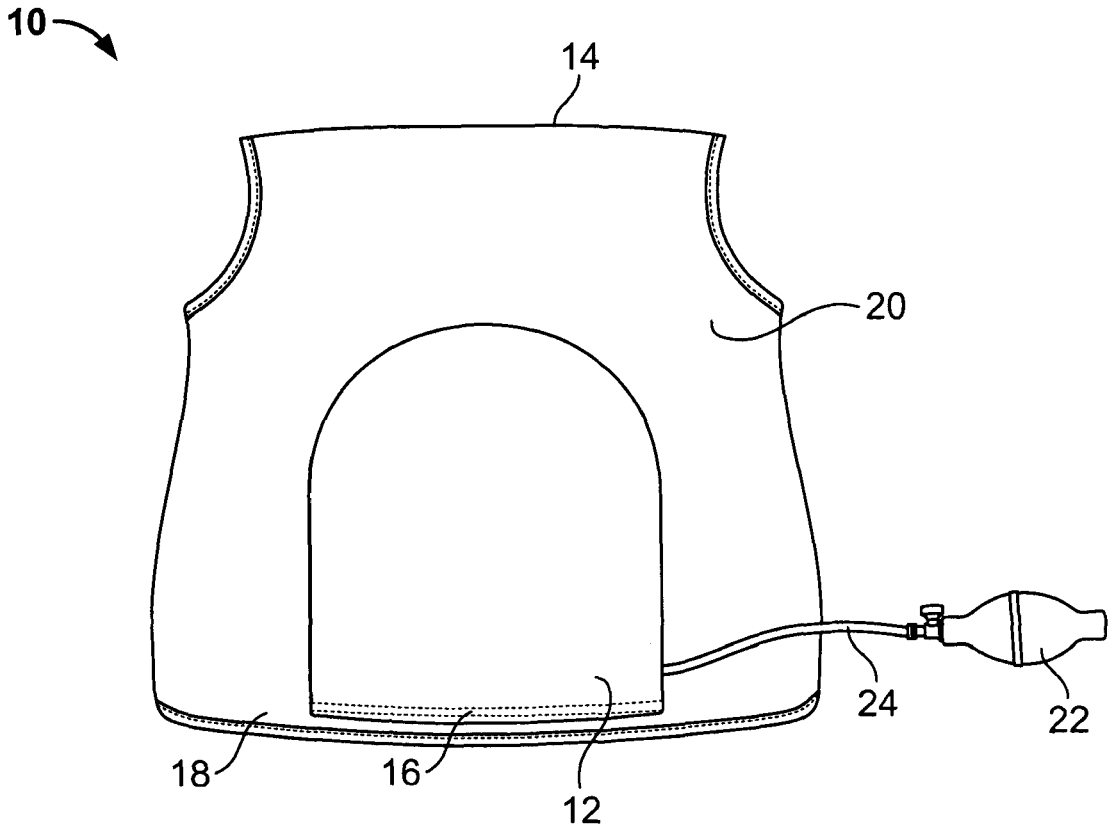
FIG. 1 is an illustration of a hunting garment including a pouch in a retracted position.

FIG. 1 is an illustration of a hunting garment 10 including a pouch 12 in a retracted position. In one embodiment, the hunting garment includes a vest 14. In other embodiments, garment 10 is at least one of a jacket and a shirt. Vest 14 and pouch 12 are fabricated, in one embodiment, from a water resistant material. Pouch 12 is configured to attach to a vest 14 via attachment devices 16. In the exemplary embodiment, attachment devices 16 are positioned on a lower portion 18 of an exterior 20 of vest 14. As such pouch 12 is positioned against exterior 20 when configured in a retracted position. In an alternative embodiment, attachment devices 16 are positioned on an interior (not shown) of vest 14, such that pouch 12 is positioned against the interior of vest 14 when configured in a retracted position.

Attachment devices 16 are at least one of hook and loop fasteners, buttons, snaps, and a zipper. Attachment devices 16 allow pouch 12 to be removable from vest 14 to facilitate cleaning or storage. Alternatively, attachment device 16 is permanent, and includes stitches, such that pouch 12 is not easily removable from vest 14.

Hunting garment 10 also includes an inflation device 22. Inflation device 22 is attached to a hose 24, which is attached to an inflatable cushion (described in further detail in FIG. 2) housed within pouch 12. Inflation device 22 allows a wearer of hunting garment 10 to manually inflate or deflate the cushion housed within pouch 12. In the exemplary embodiment, inflation device 22 includes a squeezable bulb and a pressure relief screw, which operate similarly to a bulb and relief screw included in a blood pressure cuff. In an alternative embodiment, inflation device 22 is another type of inflation apparatus, such as a valve similar to a bike tire valve.

Figure 2:
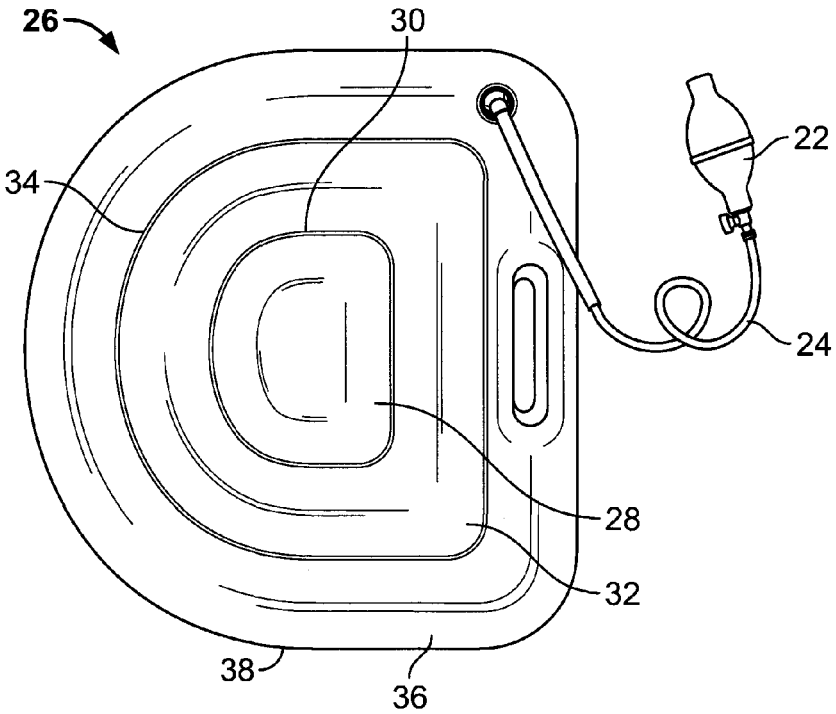
FIG. 2 is a top view of an inflation device and an inflatable cushion configured for storage in the pouch shown in FIG. 1.

FIG. 2 is a top view of an inflation device 22 and an inflatable cushion 26 configured for storage in pouch 12 shown in FIG. 1. In an exemplary embodiment, inflatable cushion 26 includes three bladders. Specifically, an inner bladder 28 having a perimeter 30 is centrally located within cushion 26. An intermediate bladder 32 extends around perimeter 30, such that intermediate bladder 32 is substantially flush against inner bladder 28. Intermediate bladder 32 has a perimeter 34. An outer bladder 36 extends around perimeter 34, such that outer bladder 36 is substantially flush against intermediate bladder 32. Outer bladder 36 has a perimeter 38, which is sized such that cushion 26 can be inserted into pouch 12.

Hose 24 is attached to outer bladder 36 and inflation device 22. Inflation device 22 is configured to inflate and deflate cushion 26. Specifically, in the exemplary embodiment, the bulb is squeezed to create air pressure, which inflates cushion 26. To deflate cushion 26, the pressure relief screw is turned such that the air pressure in cushion 26 is removed. In the alternative embodiment, in which inflation device 22 includes a valve, cushion 26 is inflated by one of, connecting a can of compressed air to the valve or connecting a pump to the valve. Cushion 26 is then deflated by pushing the pressure relief member of the valve, such that the valve opens. Inner bladder 28, intermediate bladder 32, and outer bladder 36 are configured such that air received in outer bladder 36 expands into intermediate bladder 32 and inner bladder 28 to facilitate inflating cushion 26. Likewise, removing pressure from outer bladder 36 causes pressure in intermediate bladder 32 and inner bladder 28 to also be removed.

Figure 3:
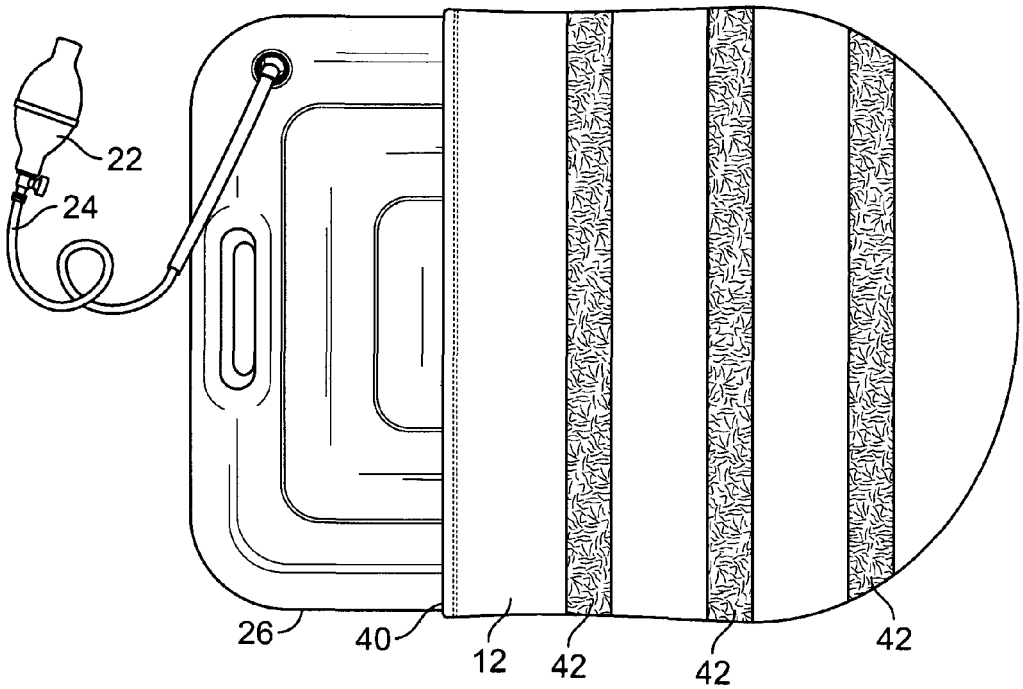
FIG. 3 is an illustration of the inflatable cushion shown in FIG. 2 partially inserted into the pouch shown in FIG. 1.

FIG. 3 is an illustration of inflatable cushion 26 shown in FIG. 2 partially inserted into pouch 12 shown in FIG. 1. Pouch 12 includes an opening 40 sized such that pouch 12 receives and retains cushion 26. Pouch 12 also includes attachment members 42 to enable pouch 12 to attach to vest 14 in a retracted position. Attachment members 42 are at least one of, hook and loop fasteners, buttons, snaps, adhesive and a zipper. In the exemplary embodiment, pouch 12 includes three attachment members 42. However, in alternative embodiments, pouch 12 includes any number of attachment members 42. For example, when attachment member is a zipper, only one attachment member 42 is needed.

In one embodiment, attachment members 42 are positioned on a top surface of pouch 12 and corresponding attachment members are placed on exterior 20 of vest 14. As such, pouch 12 is secured in a retracted position against exterior 20. In an alternative embodiment, attachment members 42 are positioned on a bottom surface of pouch 12 and corresponding attachment portions are placed on an interior of vest 14. As such, pouch 12 could be secured in a retracted position against the interior of vest 14.

Hose 24 is attached to cushion 26 such that hose 24 extends through opening 40 when cushion 26 is located within pouch 12. As such, a user of garment 10 will have access to inflation device 22 while wearing garment 10. Consequently, cushion 26 can be inflated or deflated without a user having to remove garment 10.

Figure 4:
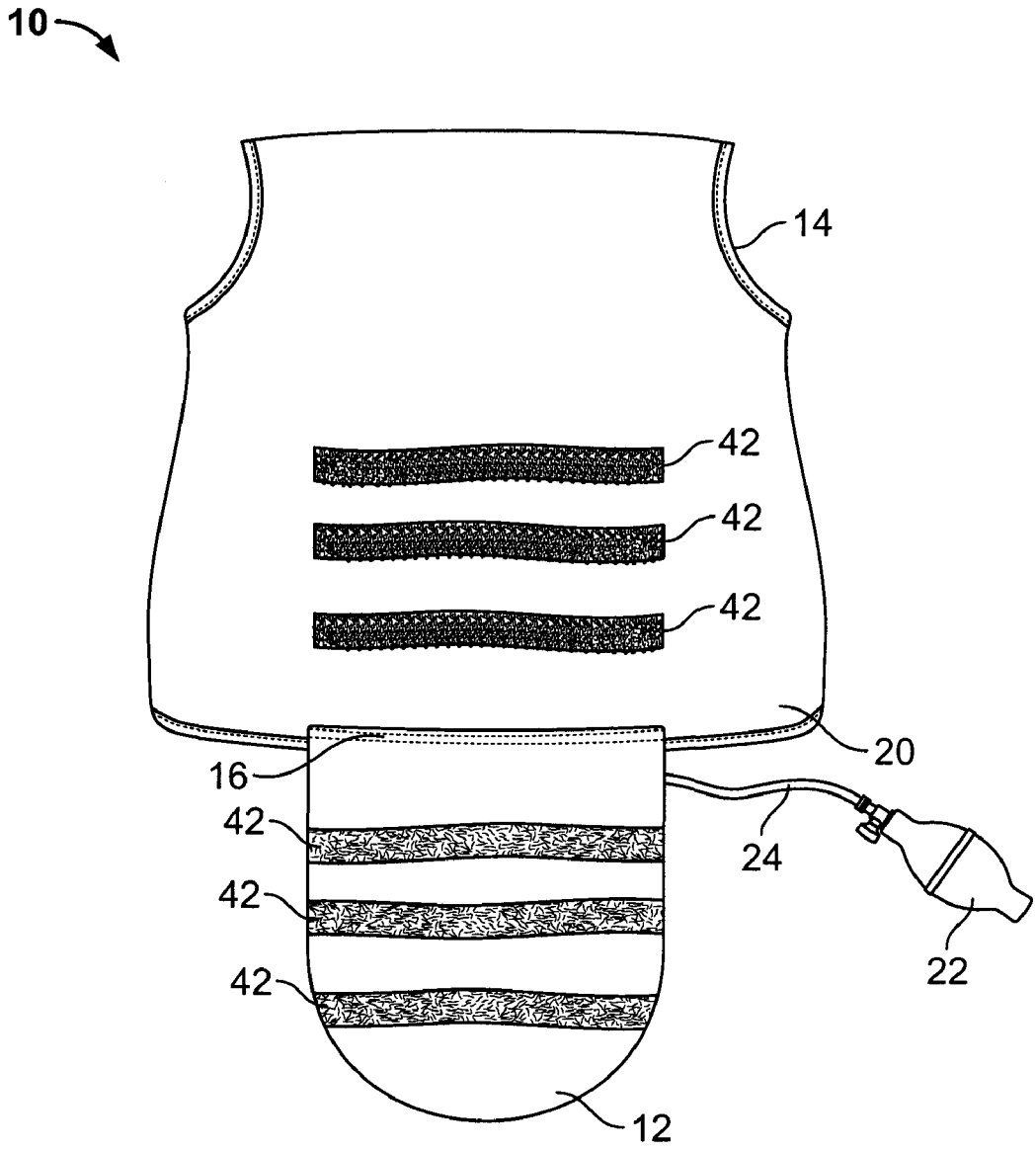
FIG. 4 is an illustration of the hunting garment shown in FIG. 1 including the pouch shown in FIG. 1 in an extended position.

FIG. 4 is an illustration of hunting garment 10 shown in FIG. 1 including pouch 12 shown in FIG. 1 in an extended position. In the exemplary embodiment, garment 10 includes attachment members 42 positioned on exterior 20 of vest 14. Corresponding attachment members 42 are positioned on a top portion of pouch 12. As such, pouch 12 is configured to be secured against exterior 20 when placed in a retracted position. In an alternative embodiment, attachment members 42 may be positioned such that pouch 12 secures to an interior of vest 14 when placed in the retracted position.

When in the extended position, pouch 12 is positioned below vest 14 to facilitate providing a seat for a user of garment 10. Hose 24 extends outward from pouch 12 to enable a user of garment 10 to access inflation device 22.

When in use, a user of garment 10 wears vest 14 like any other vest. Pouch 12 is initially in a retracted position wherein attachment members 42 of pouch 12 are attached to corresponding attachment members 42 positioned on vest 14. Pouch 12 houses cushion 26, which is initially in a deflated position. Hose 24 extends from pouch 12 such that inflation device 22 is accessible to the user. Inflation device 22 can be stored within a pocket positioned either on vest 14 or on another article of the users clothing.

When cushion 26 is to be used as a seat, attachment members 42 are detached such that pouch 12 is placed in an extended position. In the extended position, pouch 12 hangs below vest 14 and is aligned such that the user of vest 14 can sit on pouch 12. Inflation device 22 is manipulated to send air to cushion 26 via hose 24. Cushion 26 is inflated within pouch 12 to facilitate providing a comfortable seat to the user of garment 10.

The inflated seat is maintained for an extended period of time. When the user is finished with the seat, inflation device 22 is used to deflate cushion 26. After cushion 26 is deflated, pouch 12 is stored in a retracted position, against either the interior or exterior of vest 14 utilizing attachment members 42. In an alternative embodiment, pouch 12 is stored in a retracted position while cushion 26 is still inflated. Inflation device 22 is stored in a pocket positioned either on vest 14 or positioned on another article of the users clothing.

After use of garment 10, pouch 12 can be detached from vest 14 to facilitate cleaning. Likewise, cushion 26 can be removed from pouch 12 to facilitate cleaning.

In alternative embodiments (not shown), garment 10 may be configured with a padding device, for example a foam rubber, inflatable, or another cushioning device that is permanently attached to a back of garment 10. This padding device is intended to provide protection for the back of a user, for example, as the user sits on the ground he or she may lean against a base of a tree. The padding device thus provides cushioning for the back and spine of the user. The padding device is of variable width and may run the length of garment 10. In one embodiment, the cushion may overlap the portion of garment 10 where pouch 12 attaches to garment 10 for storage. This padding device may, for example, be sewn in between layers of garment 10, or be contained within a pouch that is permanently attached to either the interior or exterior of garment 10, for example, by sewing or stitching.

The above-described hunting garment facilitates providing a comfortable and dry seat for a hunter. Specifically, the hunting garment provides comfort to a hunter required to sit in one position for a long period of time. The inflatable cushion prevents a hunter from having to sit on the ground, while eliminating the need to carry stools or other seating devices. Furthermore, the inflatable cushion keeps the hunter away from moisture collected on the ground and facilitates keeping the hunter dry and warm. As a result, a hunter can have a more comfortable experience and stay dry while waiting long periods of time.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the garment described herein is described in the context of a hunting garment, it is understood that the garment described herein is not limited to hunting garments. Likewise, the hunting garment components illustrated are not limited to the specific embodiments described herein, but rather, components of the hunting garment can be utilized independently and separately from other components described herein. Moreover, the hunting garment described herein is not limited to a vest, but rather, may be a jacket, shirt, or any other article of clothing.

While the invention has been described in terms of various specific embodiments, those skilled in the art will recognize that the invention can be practiced with modification within the spirit and scope of the claims.

What is claimed is:

1. A hunting garment comprising:

an article of clothing having an interior surface and an exterior surface, at least one of the interior surface and the exterior surface comprising a first attachment member;

a pouch comprising a pouch surface and a second attachment member extending across at least a portion of the pouch surface, the second attachment member complementary to the first attachment member, wherein the pouch surface substantially faces at least one of the interior surface and the exterior surface when the second attachment member is coupled to the first attachment member, and the pouch is completely removable from at least one of the interior surface and the exterior surface; and an inflatable cushion configured to be at least partially retained within the pouch when the inflatable cushion is in an inflated configuration.

2. A hunting garment in accordance with claim 1 wherein the pouch is hingably coupled to at least a portion of the article of clothing.

3. A hunting garment in accordance with claim 1 wherein the pouch is extendable beyond the hunting garment.

4. A hunting garment in accordance with claim 1 wherein the first attachment member and the second attachment member comprise at least one of hook and loop fasteners, buttons, snaps, and a zipper.

5. A hunting garment in accordance with claim 1 further comprising an inflation device configured to inflate the inflatable cushion, the inflation device comprising a valve configured to receive a source of pressurized air to inflate the inflatable cushion.

6. A hunting garment in accordance with claim 1 wherein the inflatable cushion is completely removable from the pouch.

7. An inflatable cushion system for a hunting garment having an interior surface and an exterior surface, at least one of the interior surface and the exterior surface comprising a first attachment member, the inflatable cushion system comprising:

a pouch comprising a pouch surface and a second attachment member extending across at least a portion of the pouch surface, the second attachment member complementary to the first attachment member, wherein the pouch surface substantially faces at least one of the interior surface and the exterior surface when the second attachment member is coupled to the first attachment member, and the pouch is completely removable from at least one of the interior surface and the exterior surface; and an inflatable cushion configured to be retained within the pouch when the inflatable cushion is in an inflated configuration.

8. An inflatable cushion system in accordance with claim 7 wherein the second attachment member comprises at least one of hook and loop fasteners, buttons, snaps, and a zipper.

9. An inflatable cushion system in accordance with claim 7 further comprising an inflation device configured to inflate the inflatable cushion, the inflation device comprising a valve configured to receive a source of pressurized air to inflate the inflatable cushion.

10. A hunting garment comprising:

an article of clothing having an interior surface and an exterior surface;

a pouch comprising a pouch surface and an attachment member extending across at least a portion of the pouch surface, wherein the pouch surface substantially faces at least one of the interior surface and the exterior surface when the attachment member is coupled to at least one of the interior surface and the exterior surface;

an attachment device configured to couple the article of clothing to the pouch; and an inflatable cushion configured to be at least partially retained within the pouch when the inflatable cushion is in an inflated configuration.

11. A hunting garment in accordance with claim 10 wherein the attachment device hingably couples the pouch to at least a portion of the article of clothing.

12. A hunting garment in accordance with claim 10 wherein the article of clothing comprises at least a second attachment member that is complementary to the attachment member, wherein the pouch is completely removable from at least one of the interior surface and the exterior surface of the article of clothing.

13. A hunting garment in accordance with claim 10 wherein the attachment member comprises at least one of hook and loop fasteners, buttons, snaps, adhesive, and a zipper, and the attachment device comprises at least one of hook and loop fasteners, buttons, snaps, a zipper, and stitches, wherein the pouch is completely removable from at least one of the interior surface and the exterior surface of the article of clothing.

14. A hunting garment in accordance with claim 10 further comprising an inflation device configured to inflate the inflatable cushion, the inflation device comprising a valve configured to receive a source of pressurized air to inflate the inflatable cushion.

* * * * *